United States Patent [19]

Grapin et al.

[11] 4,247,996

[45] Feb. 3, 1981

[54] WALKING AID DEVICE

[76] Inventors: Pierre A. Grapin; Georges M. Grapin, both of 5, rue Pierre Louÿs, 75016 Paris, France

[21] Appl. No.: 910,908

[22] Filed: May 30, 1978

[30] Foreign Application Priority Data

May 31, 1977 [FR] France ..... 77 16586

[51] Int. Cl.[2] ..... A43B 3/12; A43B 5/00

[52] U.S. Cl. ..... 36/103; 36/7.5; 36/11.5

[58] Field of Search ..... 36/1, 7.5, 7.8, 11.5, 36/103, 113, 114, 132, 136

[56] References Cited

U.S. PATENT DOCUMENTS

| | | | |
|---|---|---|---|
| 2,283,595 | 5/1942 | Banister | 36/7.5 |
| 2,810,213 | 10/1957 | Jonas | 36/1 |

FOREIGN PATENT DOCUMENTS

| | | | |
|---|---|---|---|
| 2617257 | 1/1977 | Fed. Rep. of Germany | 36/132 |
| 1138512 | 6/1957 | France | 36/7.5 |

*Primary Examiner*—Patrick D. Lawson

*Attorney, Agent, or Firm*—Brisebois & Kruger

[57] ABSTRACT

A walking aid device is disclosed which permits a user to increase his stride without requiring auxiliary elements that slide or roll, and makes use only of the muscles normally used in walking. The device has a lower part-circular base made of non-skid material and extending over an angular sector corresponding to a subtending chord of length equal to 1.5 times its radius of curvature, and a board fixed across the base equidistantly from the ends of the base, to receive the users foot. The board is equal in length to the radius of curvature of the base.

3 Claims, 3 Drawing Figures

WALKING AID DEVICE

SUMMARY OF THE INVENTION

The present invention relates to a walking aid device which makes it possible fully to utilise the natural movement of walking on foot, whilst extending this movement.

It should be stated specifically that the increase in speed of the forward movement which is achieved by means of this device does not imply any marked raising of the body of the user relative to the ground and in particular does not employ any stilt or crutch.

Furthermore, the natural forward movement of walking on foot is not subjected, in the novel sports toy which is the subject of the present application, to any mechanical transformation of movement which may require the use of skates, wheels, pedals or transmission chains of any type whatsoever.

In addition, the use of this novel device does not require either a sliding movement relative to the ground or the rotation of auxiliary components or a hopping movement.

The novel device is characterised in that, in order to bring about each stride, a forward rocking movement is used which is imparted in a natural manner and successively by each foot to a device comprising a circular lower base which is made of a non-skid material, has a width which is slightly less than that of the feet of the user, corresponds to an angular sector of more than 60 degrees and extends considerably beyond the feet at the front and at the back, the said circular base representing the geometric locus of the successive points where this arc is tangential to the ground in the course of each stride, and being firmly fixed to a flat sole on which each of the feet rests and which extends along the subtending chord of a 60 degrees arc of the said circular base, located symmetrically relative to the middle part of this base.

The novel device of the invention is preferably made of a light material which has, however, great mechanical strength, and the foot is fixed to the said flat sole as in the case of a sandal, that is to say by means of any attachment system whatsoever, so as to allow "giant" steps to be made without other effort than the natural play of the muscles which are used in walking on foot.

By virture of the proportions of the novel device, which have been studied with particular care, the device can be used both as a means of relaxation and also as a means of developing, harmoniously and without risk, the musculature of the legs of the user, whether a child or an adult.

The characteristic features of the present invention will be better understood on reading the description which follows of an embodiment of the novel device according to the invention, which embodiment is given by way of a nonlimiting example and is described with reference to the attached drawing.

DETAILED DESCRIPTION OF THE PREFERRED EMBODIMENT

Figure 1:
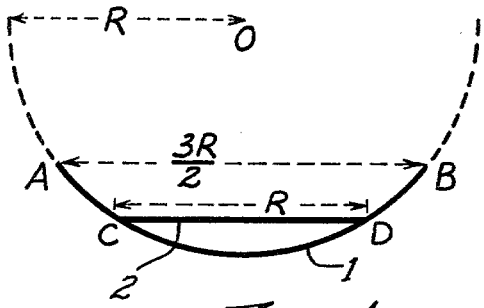
FIG. 1 is a plan view of the novel device, showing the ratios between the respective lengths of the chord which subtends the whole of the said circular lower base, the board for supporting the feet of the user, and the radius of curvature of the said base.
Figure 2:
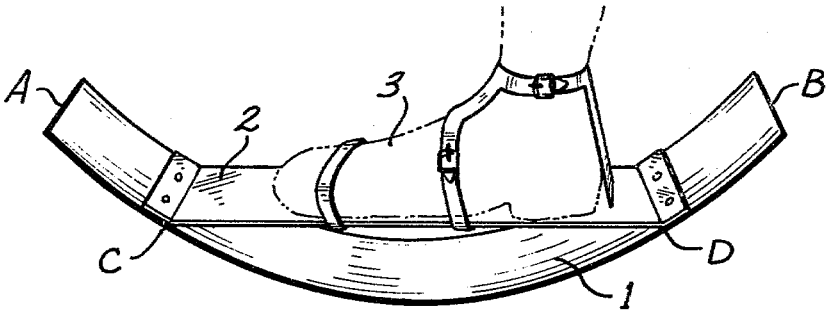
FIG. 2 is a view, in perspective, of the device of FIG. 1, showing, in addition, the relative proportions of the length of the supporting board and the length of a foot resting on the board.
Figure 3:
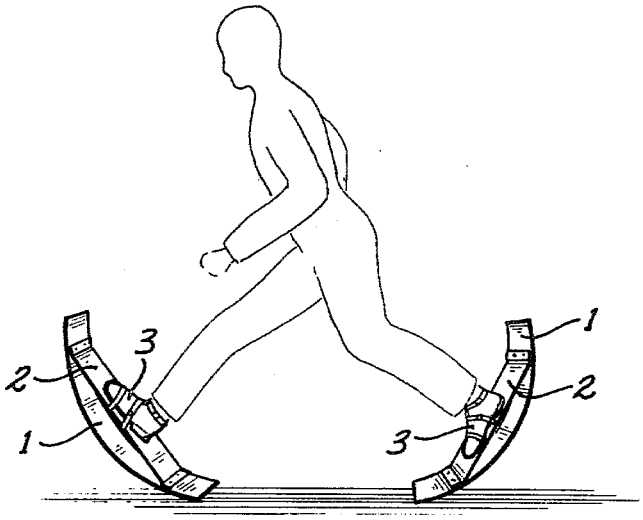
FIG. 3 is a view, in perspective, illustrating the way in which the said device is used.

In FIGS. 1 and 2, it is seen that the length of the radius of curvature R, which is generally taken to constitute the circular base 1 of the device, is equal to the length of the chord CD corresponding to the board 2 on which the foot 3 of the user rests.

The length of this radius is preferably selected to be equal to 40 cm, but it can also be suited to the actual length of the foot of the user, so that the length of the said board 2 is, for example, equal to 1.5 times the length of the foot of this user.

In other words, the arc subtended by the chord CD corresponds to an angle of 60 degrees, whereas the total angular sector contained between the points A and B of the circular base 1 corresponds to a larger angle, the chord AB which joins the two ends of this circular base corresponding to a length which is 1.5 times the radius R.

In the particular case where a radius R equal to 40 cm, is used, the length of the chord AB is equal to 60 cm and that of the chord CD is 40 cm, it being possible for the width of the device to be equal to 10 centimeters, but these figures are, of course, given only by way of indication, the radius R preferably having a length substantially equal to 1.5 times that of the foot of the user, and the invention being characterised by the equation relating the length CD of the board 2 to the radius of curvature R of the circular lower base 1, and by the ratio between the lengths of the chords AB and CD, which respectively subtend the arc AB, and the arc CD between the two points where the board 2 is firmly fixed.

Various other modifications, improvements or additions can of course be introduced into the embodiment which has just been described, and in particular so as to compensate certain anomalies in the shape of at least one foot of the user, which may require a radius of curvature of a different length, and a length of board different from that of the said radius of curvature, to be employed for this foot.

We claim:

1. A walking aid device which facilitates the normal forward movement of a walker on foot, without requiring a sliding movement or a rolling movement of auxiliary elements, and which requires use only of the muscles normally used in walking, the device comprising;

a lower part-circular base which is made of a non-skid material, has a width which is slightly less than that of the foot of a potential user, and extends over an angular sector corresponding to at least a subtending chord of a length equal to essentially 1.5 times the radius of curvature of said part-circular base;

a platform of essentially the same width as said part-circular base, and firmly fixed to the base and equidistant from the ends of said part-circular base, said platform being within said base and having an upwardly facing foot supporting surface lying essentially along a chord of said base of a length equal to said radius of curvature and which subtends an angular sector of 60 degrees of the base and is equidistant from the ends of said base; and means for securing the user's foot to said platform against movement relative to said base.

2. The device of claim 1 wherein, said platform comprises a board of a length essentially equal to said radius of curvature and securely fixed at its ends to said base.

3. The device of claim 1, wherein said base and platform have a width essentially equal to one-quarter of said radius of curvature, and the middle part of the foot of the user, when the base is on the ground, is at a maximum elevation of R(1-sine 60°).

* * * * *